US008705752B2

(12) United States Patent
Jiang et al.

(10) Patent No.: US 8,705,752 B2
(45) Date of Patent: Apr. 22, 2014

(54) LOW FREQUENCY NOISE REDUCTION CIRCUIT ARCHITECTURE FOR COMMUNICATIONS APPLICATIONS

(75) Inventors: Xicheng Jiang, Irvine, CA (US); Jungwoo Song, Irvine, CA (US); Jianlong Chen, Irvine, CA (US)

(73) Assignee: Broadcom Corporation, Irvine, CA (US)

( * ) Notice: Subject to any disclaimer, the term of this patent is extended or adjusted under 35 U.S.C. 154(b) by 1453 days.

(21) Appl. No.: 11/523,693

(22) Filed: Sep. 20, 2006

(65) Prior Publication Data

US 2008/0069373 A1 Mar. 20, 2008

(51) Int. Cl.
*H04R 5/00* (2006.01)

(52) U.S. Cl.
USPC ..... 381/28; 381/92; 381/93; 381/94.1; 381/103; 330/51; 330/149

(58) Field of Classification Search
USPC ..... 381/92, 93, 98, 102, 103, 104, 106, 381/107, 108, 22, 23, 28, 58, 62, 66, 302, 381/317, 318, 31, 71.1, 71.4, 71.11, 71.12, 381/71.13, 71.14, 83, 84, 86, 94.1, 94.8, 381/100, 101, 120, 121, 122, 123; 330/51, 330/86, 282, 254, 140.252
See application file for complete search history.

(56) References Cited

U.S. PATENT DOCUMENTS 5,983,183 A * 11/1999 Tabet et al. ..... 704/270
6,018,269 A * 1/2000 Viswanathan ..... 330/254
6,038,266 A * 3/2000 Lee et al. ..... 375/317
6,377,412 B1 * 4/2002 Freitas ..... 360/46
6,542,540 B1 * 4/2003 Leung et al. ..... 375/232
6,952,240 B2 * 10/2005 Gower et al. ..... 348/678
6,958,648 B2 * 10/2005 Cheung et al. ..... 330/86
7,072,617 B1 * 7/2006 Gupta et al. ..... 455/63.1
7,176,720 B1 * 2/2007 Prather et al. ..... 326/80
2003/0032394 A1 * 2/2003 Westra et al. ..... 455/78
2003/0144847 A1 * 7/2003 Roy et al. ..... 704/278
2005/0127993 A1 * 6/2005 Yim et al. ..... 330/133
2006/0034472 A1 * 2/2006 Bazarjani et al. ..... 381/111

OTHER PUBLICATIONS

Intersil, "Adjustable Bandpass or Bandreject Filter (HA-2841)", AN9516.1, Jun. 1996.*

* cited by examiner

*Primary Examiner* — Vivian Chin
*Assistant Examiner* — Leshui Zhang
(74) *Attorney, Agent, or Firm* — Sterne, Kessler, Goldstein & Fox P.L.L.C.

(57) ABSTRACT

A noise reduction circuit for reducing the effects of low frequency noise such as wind noise in communications applications is described. In one embodiment, the noise reduction circuit features a high pass filter formed by exploiting the existing off-chip AC coupling capacitances in making the connection to the source of audio signals. The filter may be adaptive to environmental low frequency noise level through programming the shunt resistances. A low-noise wide dynamic range programmable gain amplifier is also described. Adaptive equalization of the audio signal is also described through the utilization of programmable front-end resistors and a back-end audio equalizer.

25 Claims, 10 Drawing Sheets

Time Response

Frequency Response

Time Response

Frequency Response

Mic Path Frequency Response

HPF Frequency Response

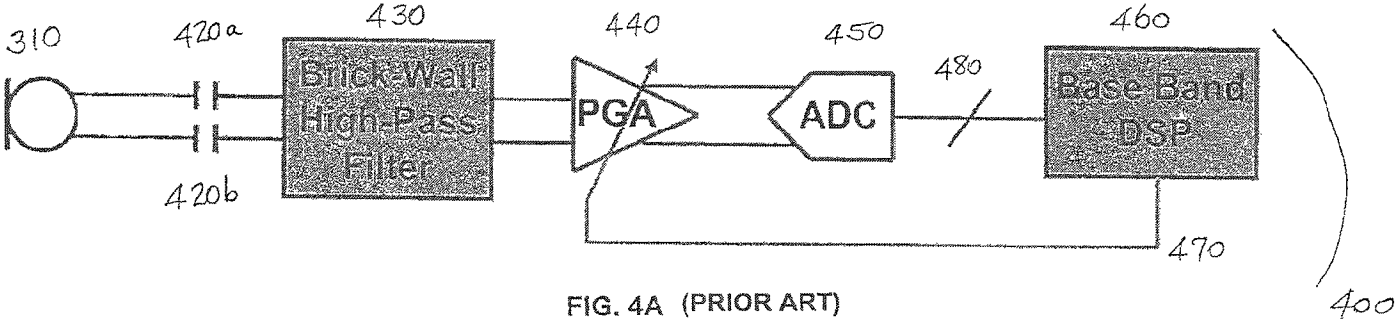
FIG. 4A (PRIOR ART)
HPF Frequency Response
FIG. 4B
(PRIOR ART)
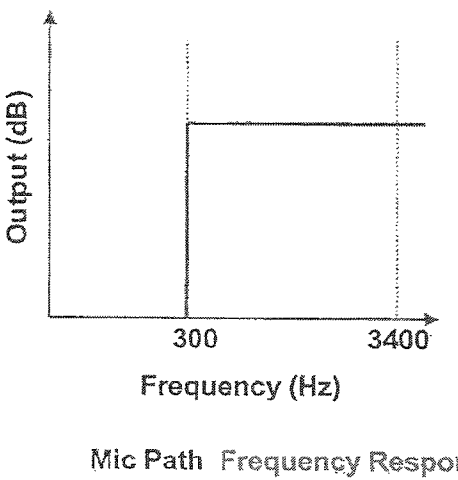
Mic Path Frequency Response
FIG. 4C
(PRIOR ART)

HPF Frequency Response

Mic Path Frequency Response

- Total gain range (0-42dB with 1dB step)
- R-TIA (0-18dB), Gm-TIA (19-42dB)
- Full scale 2Vpp_d

*For worst case: Slowslowhigh 125 C Bandwidth (20-22KHz)*

*For worst case: Slowslowhigh 125 C Bandwidth (20-22KHz)*

LOW FREQUENCY NOISE REDUCTION CIRCUIT ARCHITECTURE FOR COMMUNICATIONS APPLICATIONS

BACKGROUND OF THE INVENTION

1. Field of the Invention

The present invention relates to noise reduction circuit architecture, more particularly, to providing a noise reduction circuit architecture for communications applications.

2. Related Art

Typically, wind, air conditioning, and busy traffic introduce significant noise energy at frequencies below 150 Hz, compared with the energy levels of human voices over the bandwidth 300 Hz to 3,400 Hz. This type of low frequency ambient noise and/or wind turbulence noise, commonly referred to as wind noise, has posed special problems in communications applications.

For example, in the case of a portable headset microphone, wind noise amplitude can be very large, compared with the speech levels. A strong wind noise has a power level approximately 10 dB to 30 dB higher than the power level of a typical human voice. Wind noise generally has a frequency less than 1 kHz, and the lower the frequency, the higher the noise power.

Based on the sound sensing characteristic of the human ears, the lower frequency noise reduces one's ability to discern sounds at frequencies above the noise frequencies if the low frequency noise power is significantly higher than the voice power. Accordingly, the dynamic range of an audio codec front end diminishes with the amplitude of the wind noise.

One conventional means of solving this problem is through the use of a dedicated dynamic high-pass-filter. In such a solution, a detector determines the noise intensity and adaptively moves the high pass filter poles in response to the level of the noise intensity. Such a dynamic high pass filter is conventionally realized on a chip that is separate from the subsequent amplification and digital processing capabilities. However, such an implementation severely distorts the sound characteristic. When the wind noise is strong, the adaptive process will cause the poles of the dynamic filter to fall within the audio band. For example, when the noise intensity is high, the pole frequency will potentially be set higher than 1 kHz. As a consequence, the low frequency content of the desired audio is compressed, which in turn reduces voice intelligibility and sound fidelity.

The sound fidelity issue can be overcome by another conventional solution, namely the use of a brick-wall high pass filter. As the name suggests, a brick-wall high pass filter maintains a flat response across the entire audio frequency band. In order to realize such a flat filter response, the high pass filter must be of a very high order. This in turn demands large capacitance values and significant silicon utilization. However, such a silicon requirement is too big to be practical for consumer electronics applications.

A conventional alternative to a filtering approach to the wind noise program is to use a programmable gain amplifier (PGA). In response to the presence of strong wind noise, the gain of the PGA is reduced in order to avoid clipping at the input to the subsequent analog-to-digital converter (ADC). However, there are a number of disadvantages with this approach. Firstly, the circuitry itself contributes a significant amount of noise. With this architecture, the input-referred noise contributed by the amplification stage inside the PGA increases as the PGA gain is reduced. The effective noise generated in later stages also increases when the overall PGA gain is reduced. In addition, as the overall PGA gain reduces to accommodate the strong wind noise, the available full scale signal range also reduces. Furthermore, to avoid signal attenuation from the external microphone bias network, the input resistance of the PGA has to exceed a minimum threshold. Such a minimum limitation places a further limitation on the ability of the high pass filter formed by the input resistance and the AC coupling capacitance to effectively reduce the effects of the wind noise.

What is needed is a new noise reduction circuit architecture that provides improved low frequency noise reduction and sufficient audio fidelity while minimizing the need for additional components in a voice communication system.

SUMMARY OF THE INVENTION

The invention is directed to a circuit architecture that provides improved low frequency noise reduction. The architecture capitalizes on the existing AC coupling capacitances to provide an integrated adaptive high-pass filter while preserving a low input-referred noise over a wide dynamic range. In an embodiment, an integrated adaptive equalizer is realized such that the equalization of the compressed in-band audio is enabled.

Use of the above architecture provides several benefits. First, by combining the existing AC coupling capacitances with integrated on-chip resistors, an economical yet effective high-pass filter can be achieved. Second, by using programmable resistors, an adaptive high-pass filter can be achieved. Third, by incorporating the programmable resistors inside the equalization loop, the compressed in-band voice signals can be equalized. Finally, by adopting the resistance topology of the current invention, the input-referred noise of the PGA can be maintained at a low level over a wide dynamic range.

Further embodiments, features, and advantages of the present invention, as well as the structure and operation of the various embodiments of the present invention are described in detail below with reference to accompanying drawings.

BRIEF DESCRIPTION OF THE FIGURES

The present invention is described with reference to the accompanying drawings. In the drawings, like reference numbers indicate identical or functionally similar elements. The drawing in which an element first appears is indicated by the left-most digit in the corresponding reference number.

FIG. 4A is a conventional low-frequency noise reduction circuit architecture with a brick-wall filter.

FIG. 4B shows a typical frequency response of a brick-wall high pass filter in response to low frequency noise.

FIG. 4C highlights the response of a brick-wall high pass filter as applied to the audio signals of interest.

DETAILED DESCRIPTION OF THE INVENTION

While the present invention is described herein with reference to illustrative embodiments for particular applications, it should be understood that the invention is not limited thereto. Those skilled in the art with access to the teachings provided herein will recognize additional modifications, applications, and embodiments within the scope thereof and additional fields in which the present invention would be of significant utility.

Figure 1:
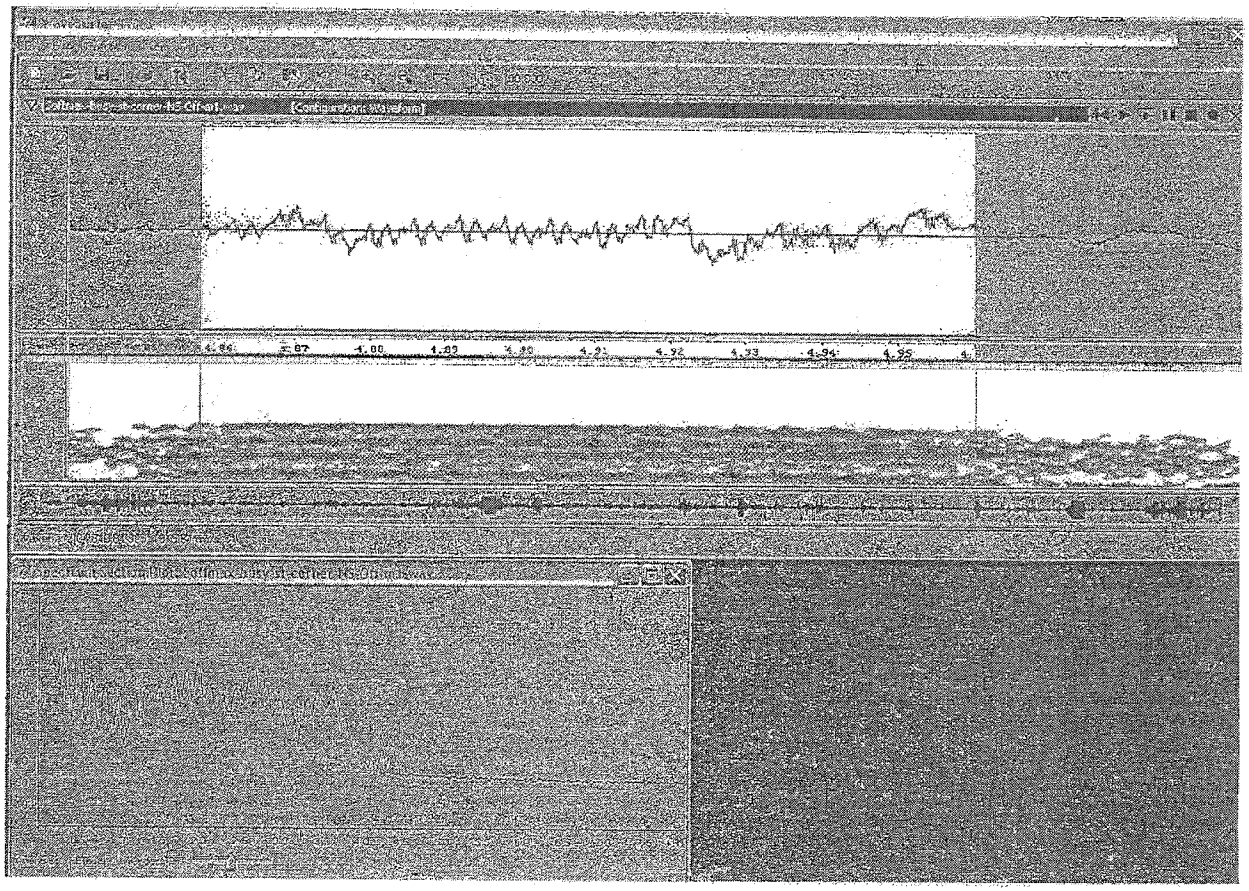
FIG. 1 (PRIOR ART)
FIG. 1 is a plot of the time and frequency response of a typical speech segment without low-frequency noise.
Figure 2:
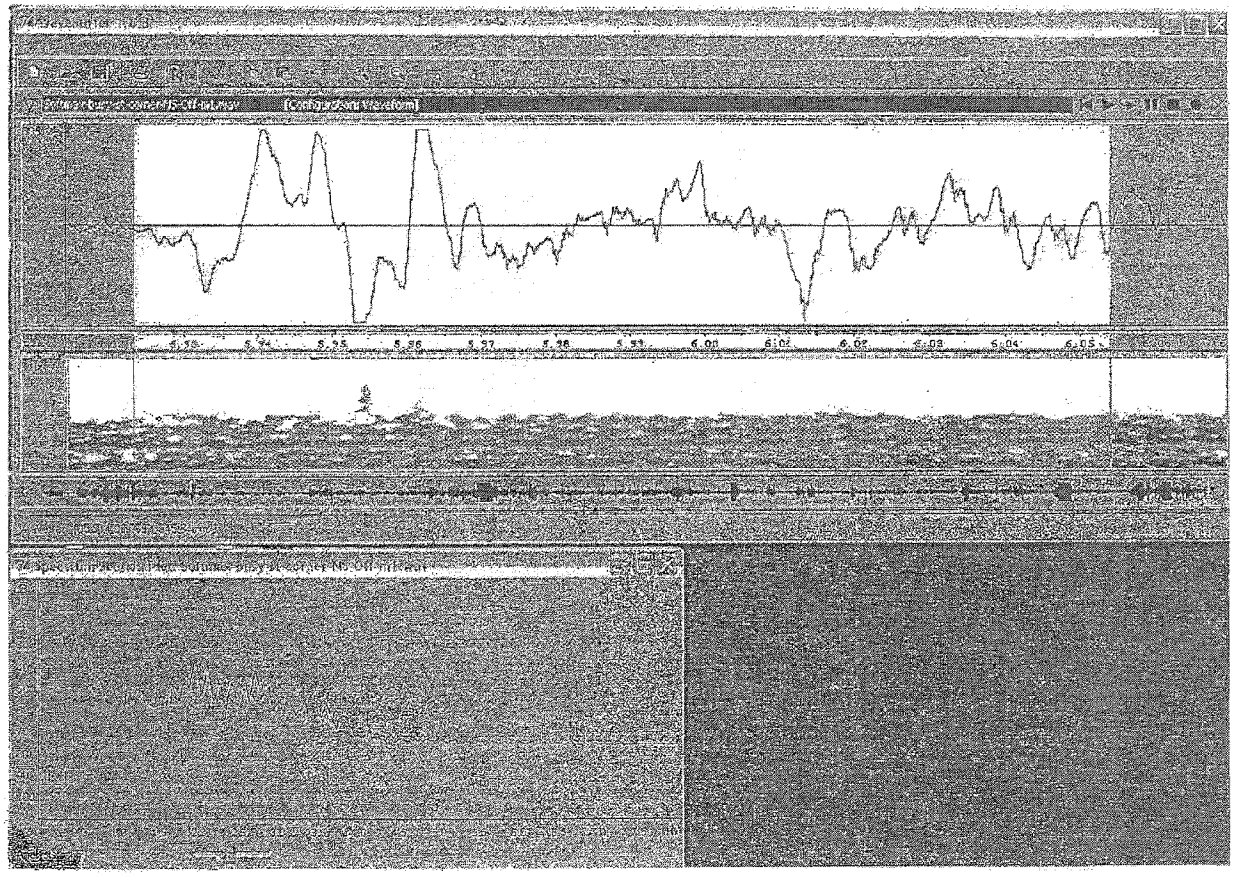
FIG. 2 (PRIOR ART)
FIG. 2 is a plot of the time and frequency response of a typical speech segment with the addition of strong low-frequency noise.

In voice communication systems, significant low frequency noise can affect the fidelity of the audio signals transmitted. FIG. 1 is a plot of the time response 110 and the frequency response 120 of a typical speech segment without wind noise. FIG. 2 is a plot of the time response 210 and frequency response 220 of a typical speech segment, but now with an added strong wind noise component. A strong wind noise can have a power level approximately 10 dB to 30 dB higher than the typical talker voice level. As noted by comparing FIGS. 1 and 2, wind noise is particularly strong at frequencies below 1 kHz.

Based on the sound sensing characteristic of the human ears, the lower frequency noise reduces one's ability to discern sounds at frequencies above the noise frequencies if the noise power is significantly higher than the voice power. Accordingly, the dynamic range of an audio codec front end diminishes with increasing amplitude of the wind noise.

Figure 3A:
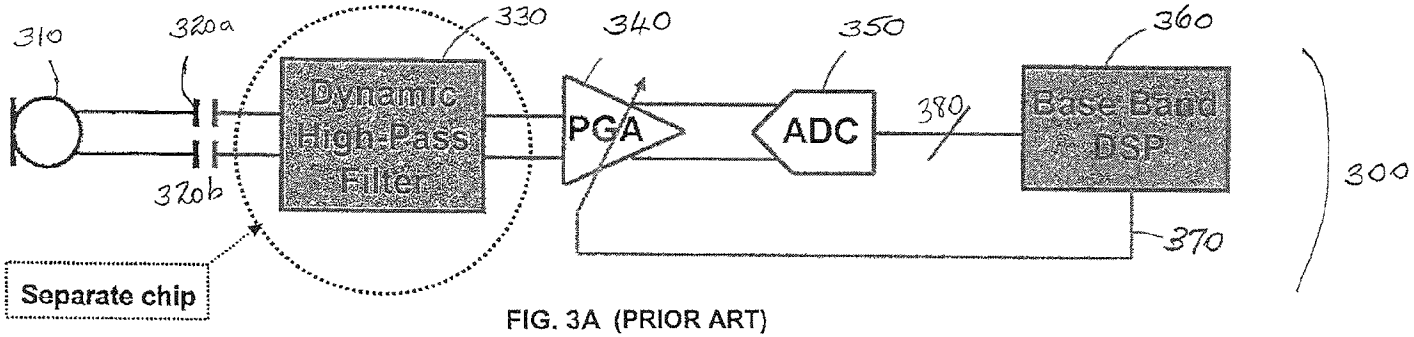
FIG. 3A (PRIOR ART)
FIG. 3A is a conventional low-frequency noise reduction circuit architecture using a dynamic filter.

This issue can be solved through the use of a dedicated dynamic high-pass-filter. FIG. 3A shows a conventional wind noise reduction circuit architecture with a dynamic filter. The conventional wind noise reduction circuit architecture 300 is configured to be coupled to microphone 310. The conventional wind noise reduction circuit architecture 300 comprises two coupling capacitors 320*a* and 320*b*, a dynamic high pass filter 330, a programmable gain amplifier (PGA) 340, an analog-to-digital converter (ADC) 350, and a base band digital signal processor (DSP) 360.

Microphone 310 is coupled to the two coupling capacitors 320*a* and 320*b*. Dynamic high-pass filter 330 is coupled to coupling capacitors 320*a* and 320*b*, and to the PGA 340. The output of the PGA 340 is coupled to the ADC 350, which in turn provides a digital output signal 380 that is coupled to the base band DSP 360. The base band DSP 360 analyzes the digital output signal 380 and provides an adjustment signal 370 which is coupled to the PGA 340.

Figure 3C:
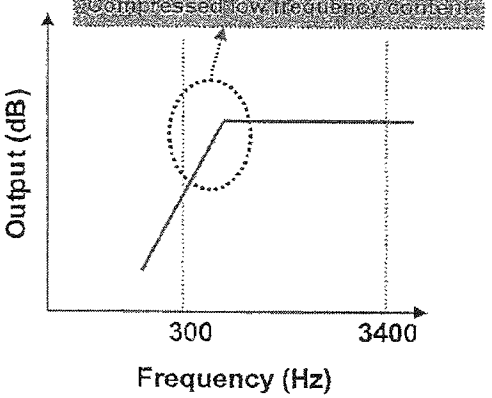
FIG. 3C (PRIOR ART)
FIG. 3C highlights the compressed response of a dynamic high pass filter as applied to the audio signals of interest.
Figure 3B:
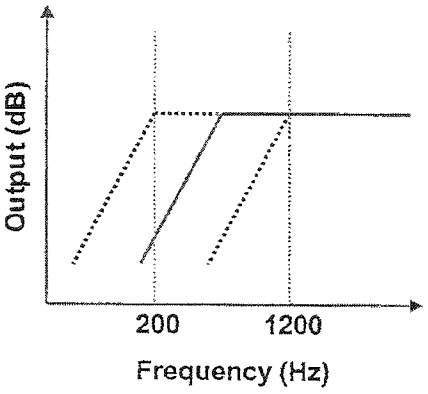
FIG. 3B (PRIOR ART)
FIG. 3B shows a typical frequency response of a dynamic high pass filter in response to low-frequency noise.

FIG. 3B shows a typical frequency response of the dynamic high pass filter 330 in response to varying amplitudes of wind noise. FIG. 3C highlights the compressed response to audio signals generated by the microphone 310.

In this conventional solution, a detector determines the level of noise intensity and adaptively moves the high pass filter poles in response to the noise intensity level. Such a dynamic high pass filter is normally implemented on a chip that is separate from the subsequent amplification and digital processing capabilities. However, as noted earlier, such an implementation severely distorts the audio characteristic by shifting the filter poles within the audio band in response to the high noise intensity. As a consequence, audio intelligibility and sound fidelity are reduced.

This problem of low-frequency compression can be solved through the use of a brick-wall filter. FIG. 4A shows a conventional wind noise reduction circuit architecture with brick-wall filter. The conventional wind noise reduction circuit architecture with brick-wall filter 400 is configured to be coupled to microphone 310. The conventional wind noise reduction circuit architecture with brick-wall filter 400 comprises two coupling capacitors 420*a* and 420*b*, brick-wall high pass filter 430, PGA 340, ADC 350, and base band DSP 360.

Microphone 310 is coupled to the two coupling capacitors 420*a* and 420*b*. Brick-wall high-pass filter 430 is coupled to coupling capacitors 420*a* and 420*b* and to the PGA 440. The output of the PGA 440 is coupled to the ADC 350, which in turn provides a digital output signal 480 that is coupled to the base band DSP 460. The base band DSP 460 analyzes the digital output signal 480 and provides an adjustment signal 470 which is coupled to the PGA 440.

FIG. 4B shows a typical frequency response of the brick-wall high pass filter 430 in response to varying amplitudes of wind noise. FIG. 4C highlights the response applied to the audio spectrum of signals generated by the microphone 310.

As noted earlier, while the use of a brick-wall high pass filter overcomes the sound fidelity problem described above. As the name suggests, a brick-wall high pass filter maintains a flat response across the entire voice communication band, the high order demands large capacitance values and significant silicon utilization, a requirement that is too big to be practical for consumer electronics applications.

Figure 5:
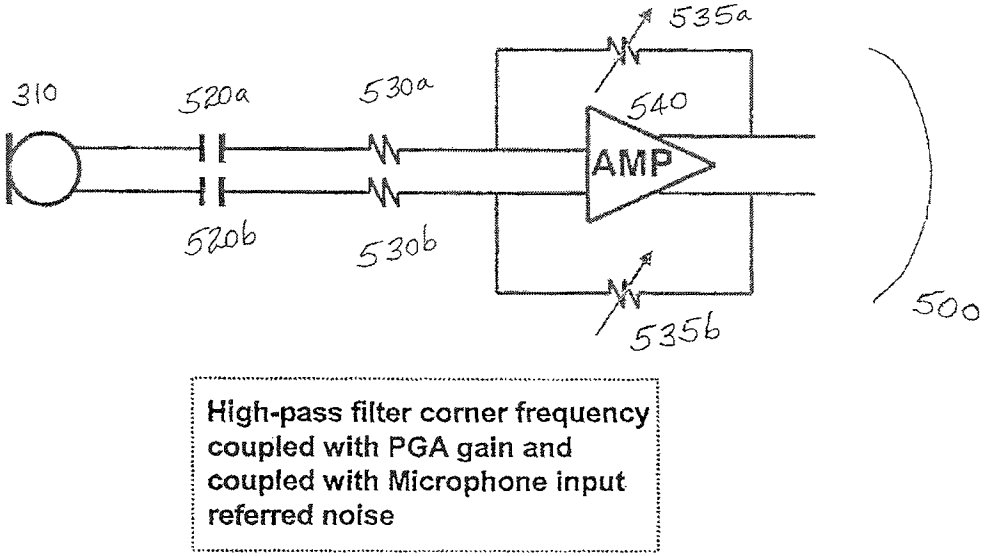
FIG. 5 (PRIOR ART)
FIG. 5 is a conventional microphone PGA circuit architecture.

Another conventional solution to the problem of wind noise uses the simple programmable gain amplifier (PGA). FIG. 5 is a conventional microphone PGA circuit architecture. The conventional microphone PGA circuit architecture 500 is configured to be coupled to microphone 310. The conventional microphone PGA circuit architecture 500 comprises two coupling capacitors 520*a* and 520*b*, two series resistances 530*a* and 530*b*, two parallel resistances 535*a* and 535*b*, and a differential amplifier 540.

Microphone 310 is coupled to the two coupling capacitors 520*a* and 520*b*. Series resistances 530*a* and 530*b* are coupled to coupling capacitors 520*a* and 520*b*, to the differential amplifier 540, and coupled to the parallel resistances 535*a* and 535*b*. The parallel resistances 535*a* and 535*b* are also coupled to the output of the differential amplifier 540.

The coupling of the coupling capacitances 520*a* and 520*b*, and series resistances 530*a* and 530*b* form a high pass filter. Series resistances 530*a* and 530*b*, parallel resistances 535*a* and 535*b*, and the amplifier 540 form the programmable amplifier. By selecting the parallel resistances 535*a* and 535*b* to be variable resistances, the gain of the PGA is variable and may be set to optimize the overall circuit performance. Therefore, in response to the presence of strong wind noise, the gain of the PGA is reduced in order to avoid clipping in the subsequent ADC. In this conventional architecture, the input resistances 530*a* and 530*b* contribute a significant amount of noise. In order to reduce the overall input referred noise, this input resistance is set to just meet the minimum requirement. With this architecture, the input-referred noise contributed by the amplification stage inside the PGA increases while reducing PGA gain. The effective noise generated in later stages also increases when the overall PGA gain is reduced. Moreover, as the overall PGA gain reduces to accommodate the strong wind noise, the available full scale reduces. Even though the input resistance 530*a* and 530*b* can be programmed to program the corner frequency of high-pass filter, to avoid signal attenuation from the external microphone bias network, the PGA input resistance value has to meet or exceed a minimum threshold. Such a minimum limitation further limits the ability of the high pass filter formed by the input resistance and the AC coupling capacitance to effectively reduce the effects of the wind noise.

Figures 6A, 6B, 6C:
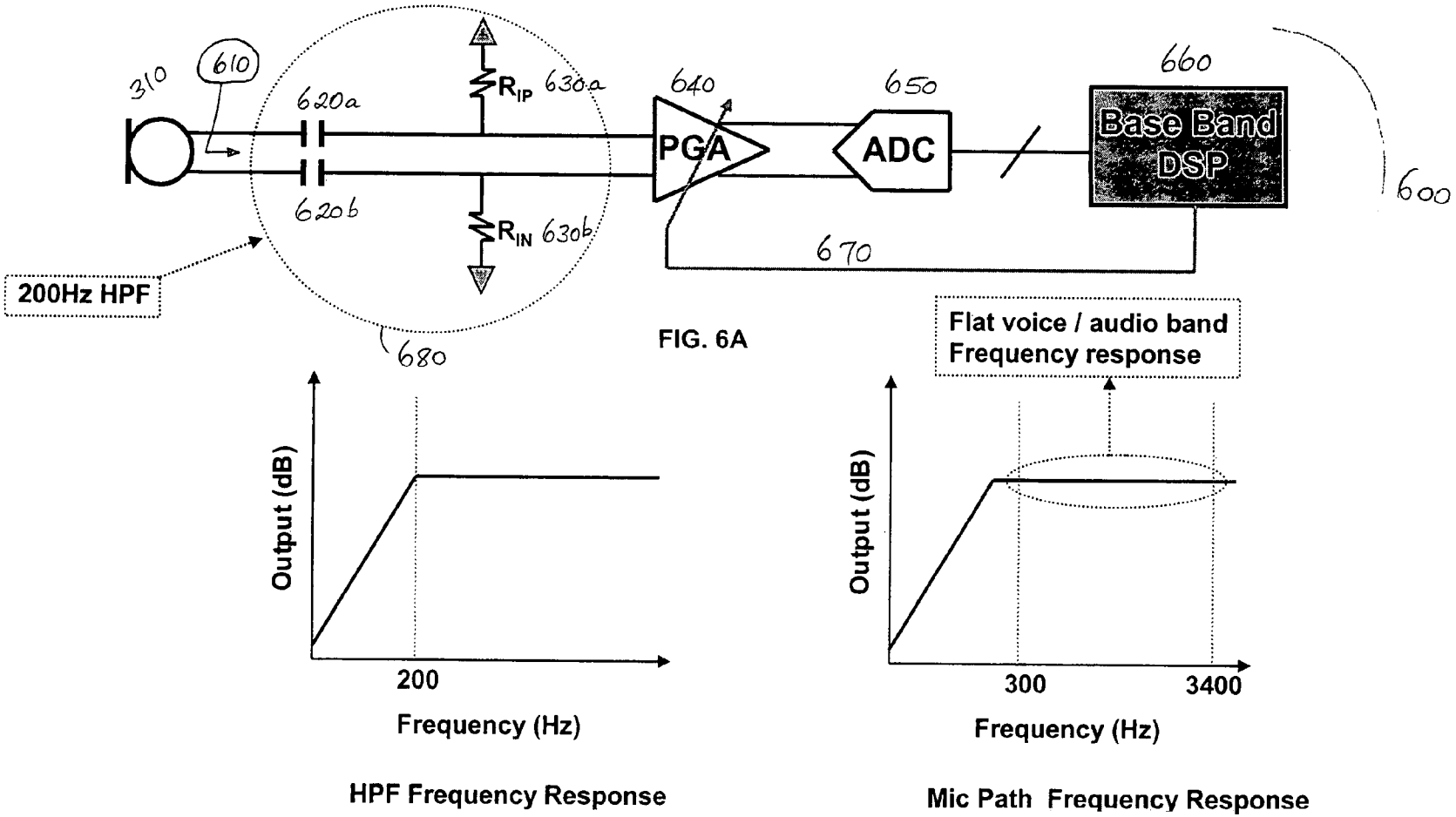
FIG. 6A is a low-frequency noise reduction circuit architecture, according to an embodiment of the present invention.
FIG. 6B shows an exemplary frequency response of a high-pass filter with a corner frequency of approximately 200 Hz, according to an embodiment of the present invention.
FIG. 6C shows an exemplary frequency response of a noise reduction circuit using the high pass filter with a corner frequency of approximately 200 Hz, according to an embodiment of the present invention.

FIG. 6A shows an embodiment of the invention, wherein a noise reduction circuit 600 addresses the issues created by the conventional approaches raised above, without the need for extra pins or additional external components. The noise reduction circuit architecture 600 comprises two off-chip AC coupling capacitors 620*a* and 620*b*, two grounding resistors 630*a* and 630*b*, a PGA 640, an ADC 650, and a base band DSP 660.

The noise reduction circuit architecture 600 receives a differential input signal 610 from an external microphone 310 via the two off-chip AC coupling capacitors 620*a* and 620*b*. The AC coupling capacitances 620*a* and 620*b* are coupled to the input of the PGA 640, as well as to ground via the ground resistors 630*a* and 630*b*. The output of the PGA 640 is coupled to the input of the ADC 650. Next, the digital output of the ADC 640 is coupled to the input of a base band DSP 660, which in turn outputs a control signal 670 that is coupled to the PGA 640. The control signal 670 is used to control the gain of the PGA 640.

In the embodiment of the invention shown in FIG. 6A, the on-chip grounding resistors Rip 630*a* and Rin 630*b*, together with the off-chip AC coupling capacitors 620*a* and 620*b*, form a first order high-pass filter 680 that suppresses the low frequency wind noise. FIG. 6B shows an exemplary frequency response of the high-pass filter 680, which was designed to have a corner frequency of approximately 200 Hz. FIG. 6C shows the frequency response of the noise reduction circuit 600 which uses a high-pass filter 680 with a corner frequency of approximately 200 Hz. The circuit designs described above are merely examples and designers are free to make alternative design choices as circumstances warrant. In particular, different levels of low frequency noise signals can result in a different choices for the optimal corner frequency for the high-pass filter 680.

In the noise reduction circuit architecture 600, the grounding resistors Rip 630*a* and Rin 630*b* contribute only common-mode noise that will be rejected by the subsequent differential circuitry. Consequently, much larger resistor values are available for selection by the circuit designer, with the benefit of lower corner frequencies or lower capacitance values for a given corner frequency without altering the referred noise profile.

Figure 7:
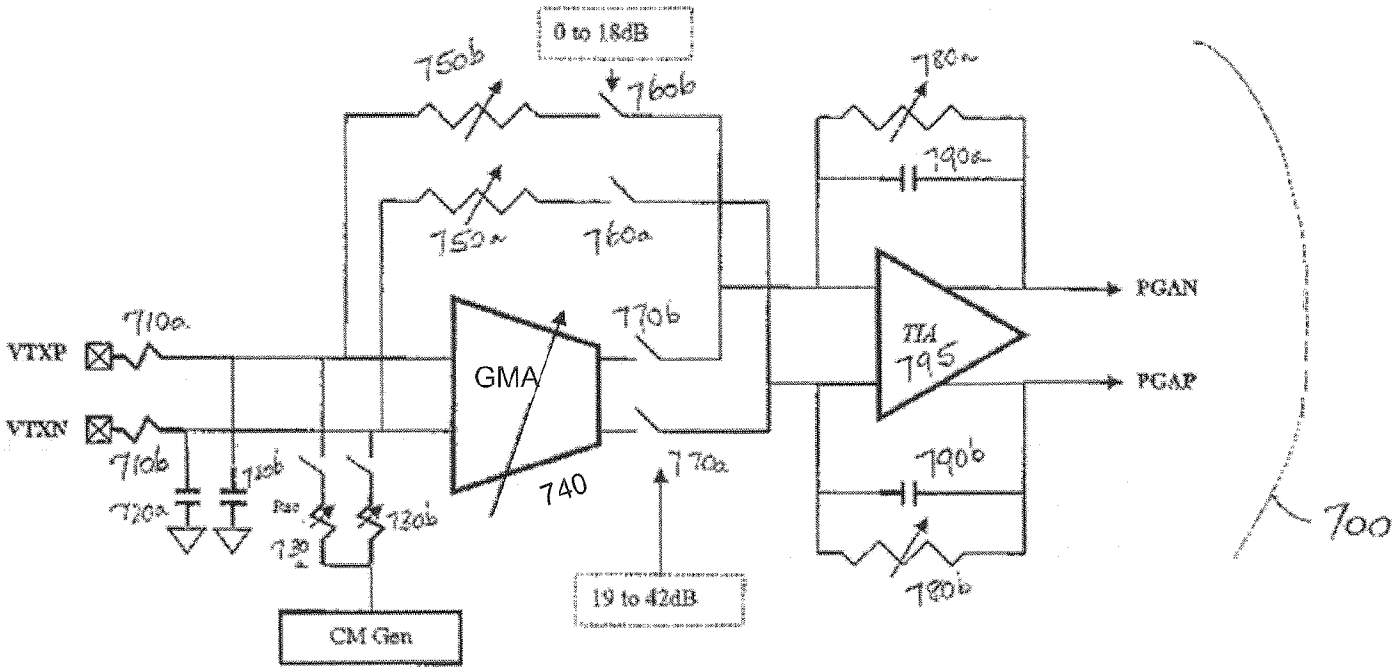
FIG. 7 is an exemplary PGA circuit architecture, according to an embodiment of the present invention.

In another embodiment of the invention, FIG. 7 illustrates a specific circuit architecture for the PGA 640. In this embodiment, the PGA circuit architecture 640 comprises two input series resistances 710*a* and 710*b*, two grounding capacitances 720*a* and 720*b*, two variable grounding resistances 730*a* and 730*b*, a transconductance amplifier (GMA) 740, two series feedback resistors 750*a* and 750*b*, two series feedback switches 760*a* and 760*b*, two GMA output switches 770*a* and 770*b*, a transimpedance amplifier (TIA) 795, two variable feedback resistances 780*a* and 780*b*, and two feedback capacitances 790*a* and 790*b*.

The input series resistances 710*a* and 710*b* are coupled to the shunt capacitances 720*a* and 720*b*. Also coupled to shunt capacitances 720*a* and 720*b* are a pair of variable resistances 730*a* and 730*b*, which are in turn coupled to the externally applied programmable input signal of the PGA 640. Still further coupled to the shunt capacitances 720*a* and 720*b* is the input to a GMA 740. Switches 770*a* and 770*b* alternatively couple or uncouple the output of the GMA 740 to the input of the TIA 795. Synchronized, but of opposite phase with switches 770*a* and 770*b*, are switches 760*a* and 760*b*. When switches 770*a* and 770*b* couple the output of the GMA 740 to the input of the TIA 795, the switches 760*a* and 760*b* uncouple the resistors 750*a* and 750*b* to the input of the TIA 795. Accordingly, using these synchronized switch pairs, either the resistances 750*a* and 750*b* are in series with the TIA 795, or the GMA 740 is in series with the TIA 795. Finally, in a shunted feedback arrangement across the TIA 795 is a parallel variable resistor pair 780*a* and 780*b* and a parallel capacitance pair 790*a* and 790*b*.

In making design choices using the PGA topology shown in FIG. 7, one design focus is to reduce the noise contribution from the input transistor, which is the dominant source of noise in this topology. Also, the input of the PGA 640 is a transistor gate and thus the input impedance of the PGA 640 is extremely high (for example near infinite).

Using the topology shown in the embodiment in FIG. 7, the PGA 640 consists of a switched transconductance amplifier stage (based on the GMA 740) cascaded with a transimpedance amplifier stage (based on the TIA 795). The transconductance amplifier stage can be switched into the cascade, or disconnected from the cascade, depending on the switching states of synchronized switch pairs 760*a*, 760*b*, 770*a*, and 770*b*. As an example of a PGA design using this architecture, the transimpedance amplifier stage can provide approximately 0 to 18 dB of gain, while the switchable transconductance amplifier stage provides an additional 0 to 24 dB of gain, making an approximate total of 42 dB of variable gain available for the overall PGA 640. The PGA gain is variable, but an unpleasant clicking sound can result from changes in the PGA gain that are too abrupt, such as the 3 dB gain changes commonly used in commercial design practice. This unpleasant clicking sound can be avoided by using components that provide a 1 dB step size in gain adjustments of the PGA 640.

Figure 8:
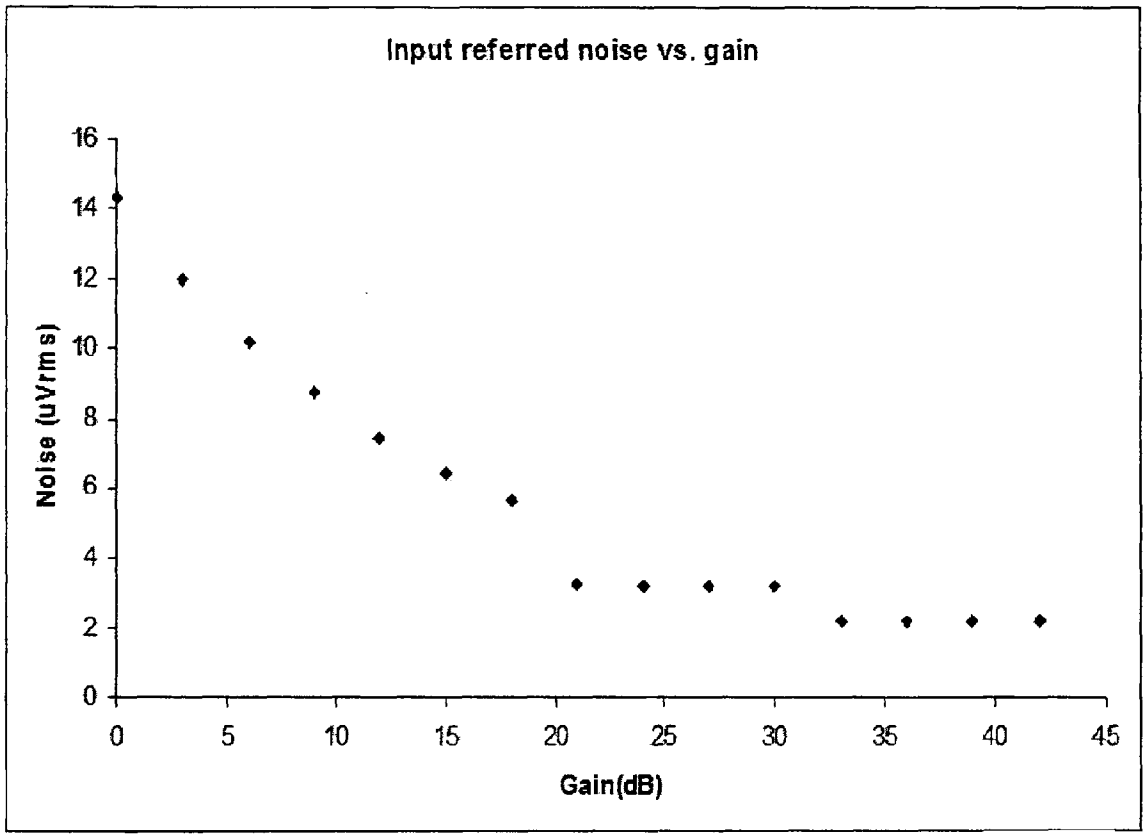
FIG. 8 is a plot of test results showing the PGA input-referred noise variation with gain, according to an embodiment of the present invention.
Figure 9:
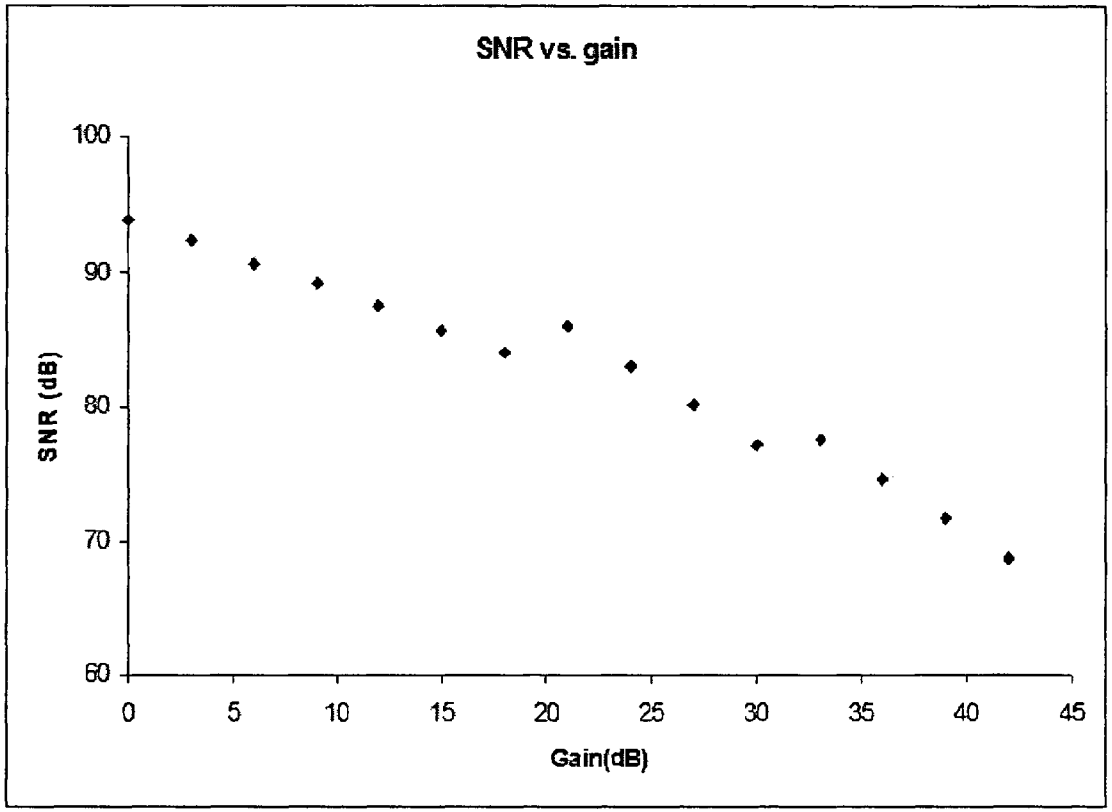
FIG. 9 is a plot of test results showing the PGA signal-to-noise ratio variation with gain, according to an embodiment of the present invention.

Deploying the PGA topology shown in FIG. 7 into the noise reduction circuit architecture of FIG. 6A results in the following operating scenario. In an exemplary embodiment of this invention, the noise reduction circuit has a signal to noise ratio (SNR) in excess of 60 dB when the PGA 640 is set to its maximum gain. While the PGA gain is at the high end of its available gain range, 21 dB to 42 dB, the input referred noise is relatively flat. FIG. 8 is a plot of test results showing the PGA input-referred noise variation with gain, according to an embodiment of the present invention. FIG. 9 is a plot of test results showing the PGA signal-to-noise ratio variation with gain, according to an embodiment of the present invention.

Upon activation of the noise reduction circuit in a given environment, the base band DSP 660 adapts to the environment by progressively increasing the gain of the PGA 640, starting with the minimum PGA gain, until the output voltage swing of the PGA 640 is close to clipping. If a strong low frequency noise (e.g. wind noise) is present, the gain of the PGA 640 will settle at a very low level. At this PGA gain setting, the noise reduction circuit will maintain a performance superior to that of the external microphone, as a commercial microphone has a SNR that is less than 60 dB. In this high noise environment, a significant portion of the wind noise is attenuated by the front-end high-pass filter 680, with still further wind noise removed by the base band DSP 660. In the case of a quiet environment, the gain of the PGA 640 is progressively increased until the voice signal reaches full scale. Should the environment change from a quiet environment to one of turbulence, the gain of the PGA 640 will be dynamically reduced by the base band DSP 660 to a more optimum gain setting.

Figures 10A, 10B, 10C, 10D:
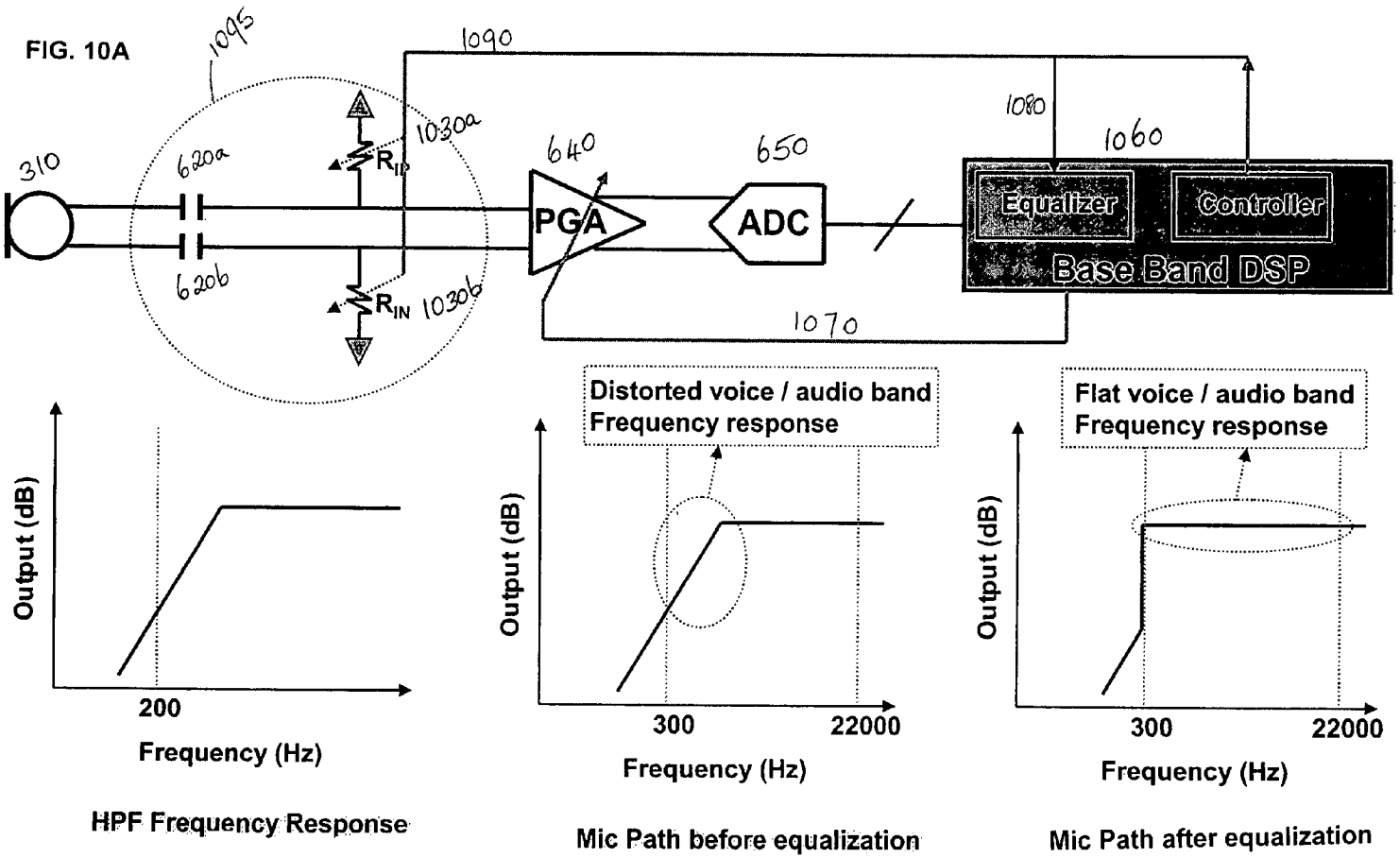
FIG. 10A shows an adaptive equalizer low-frequency noise reduction circuit architecture, according to an embodiment of the present invention.
FIG. 10B shows an exemplary frequency response of a high-pass filter, which was designed to have an aggressive corner frequency in excess of 300 Hz.
FIG. 10C shows the frequency response of a noise reduction circuit that uses a high-pass filter with an aggressive corner frequency in excess of 300 Hz.
FIG. 10D shows the overall frequency response of a noise reduction circuit that uses a high-pass filter with an aggressive corner frequency in excess of 300 Hz together with a synchronized equalizer.

FIG. 10A shows yet another embodiment of the invention, in which an adaptive equalizer approach is utilized. The adaptive equalizer wind noise reduction architecture 1000 comprises two off-chip AC coupling capacitances 620*a* and 620*b*, two adjustable grounding resistors 1030*a* and 1030*b*, a PGA 640, an ADC 650, and a base band DSP 1060. In an embodiment, the two resistors in the filter (1030*a* and 1030*b*), the PGA 640, the ADC 650 and the base band DSP 1060 are integrated onto a single substrate. Within the base band DSP 1060 is an equalizer function and a controller function.

The noise reduction circuit architecture 1000 receives a differential input signal 610 from an external microphone 310 via the two off-chip AC coupling capacitors 620*a* and 620*b*. The AC coupling capacitances 620*a* and 620*b* are coupled to the input of the PGA 640, as well as to ground via the ground resistors 1030*a* and 1030*b*. The output of the PGA 640 is coupled to the input of the ADC 650. Next, the digital output of the ADC 640 is coupled to the input of a base band DSP 1060, which in turn outputs a control signal 1070 that is coupled to the PGA 640. The control signal 1070 is used to control the gain of the PGA 640. In addition, the base band DSP 1060 provides a control signal 1080 that is coupled to the equalizer within the base band DSP 1060. Still further, the base band DSP 1060 provides another control signal 1090 that is coupled to the variable ground resistances 1030*a* and 1030*b*.

Based on the strength of the low frequency noise profile, the value of the variable ground resistors 1030*a* and 1030*b* can be controlled by the base band DSP 1060. Since these variable ground resistors 1030*a* and 1030*b* are fully integrated with the rest of the noise reduction circuitry 1000, the high-pass filter 1095 can be aggressively set so that the low frequency noise can be more attenuated at the price of distorting the low frequency audio signals. However, by incorporating a voice equalizer internal to the base band DSP 1060, the compression of the audio signals resulting from the high-pass filter 1095 can be overcome and the voice fidelity restored. Accordingly, both the front-end high pass filter 1095 and the internal voice equalizer are adaptive and are synchronized by the base band DSP 1060. Thus, using this approach, the fidelity of the audio signals are maintained, regardless of the strength of the low frequency noise.

FIG. 10B shows an exemplary frequency response of the high-pass filter 1095, which was designed to have an aggressive corner frequency in excess of 300 Hz. FIG. 10C shows the frequency response of the noise reduction circuit 1000 which uses a high-pass filter 1095 with an aggressive corner frequency in excess of 300 Hz. FIG. 10D shows the overall frequency response of the noise reduction circuit 1000, where a high-pass filter 1095 with an aggressive corner frequency in excess of 300 Hz together with a synchronized equalizer has been applied.

The circuit designs described above are merely examples and designers are free to make alternative design choices as circumstances warrant. In particular, different levels of low frequency noise signals can result in a different choices for the aggressive corner frequency for the high-pass filter 1095 and its synchronized equalizer.

Various exemplary embodiments of noise reduction circuits according to the approaches shown in FIGS. 6, 7 and 10 have been presented. The present invention is not limited to these examples. These examples are presented herein for purposes of illustration, and not limitation. Alternatives (including equivalents, extensions, variations, deviations, etc., of those described herein) will be apparent to persons skilled in the relevant art(s) based on the teachings contained herein. Such alternatives fall within the scope and spirit of the present invention.

CONCLUSION

While various embodiments of the present invention have been described above, it should be understood that they have been presented by way of example, and not limitation. It will be apparent to persons skilled in the relevant art that various changes in form and detail can be made therein without departing from the spirit and scope of the invention.

What is claimed is:

1. A noise reduction circuit, comprising:

a filter comprising two grounding resistors and two off-chip coupling capacitors coupled to an audio signal source;

a programmable gain amplifier (PGA) coupled to the filter, the PGA having an input that allows a gain of the PGA to be adjusted in response to a control signal received on the input, wherein the PGA is formed by a cascade of a transconductance amplifier and a transimpedance amplifier based on the control signal;

a synchronized switch pair configured to couple or uncouple an output of the transconductance amplifier to an input of the transimpedance amplifier based on the control signal;

an analog-to-digital converter (ADC) coupled to the PGA; and a base band digital signal processor (DSP) coupled to the ADC, the base band DSP adapted to provide the control signal for the input to the PGA, based on a noise level of an output of the PGA.

2. The noise reduction circuit of claim 1, wherein the two grounding resistors in the filter, the PGA, the ADC and the base band DSP are integrated onto a single substrate.

3. The noise reduction circuit of claim 1, wherein the filter is a high pass filter.

4. The noise reduction circuit of claim 3, wherein the high pass filter is a one-pole high pass filter.

5. The noise reduction circuit of claim 4, wherein the one-pole high pass filter has its pole set to below 1 kHz.

6. The noise reduction circuit of claim 1, wherein the two off-chip coupling capacitors are configured in parallel.

7. The noise reduction circuit of claim 6, wherein the base band DSP controls the filter and the base band DSP comprises an equalizer that is synchronized to the filter.

8. The noise reduction circuit of claim 1, wherein the transconductance amplifier is switchable.

9. The noise reduction circuit of claim 1, wherein an input impedance of the PGA is substantially infinite.

10. The noise reduction circuit of claim 1, wherein an input referred noise is determined based on the two grounding resistors and the two off-chip coupling capacitors.

11. The noise reduction circuit of claim 1, wherein the PGA maintains a flat noise profile over a wide PGA gain.

12. The noise reduction circuit of claim 1, wherein the PGA preserves a high signal-to-noise ratio (SNR) over a broad PGA gain range.

13. The noise reduction circuit of claim 1, wherein the gain of the PGA is adjustable in increments of 1 dB steps.

14. The noise reduction circuit of claim 1, wherein the base band DSP gradually increases the PGA gain by no more than 1 dB per step.

15. The noise reduction circuit of claim 1, wherein the base band DSP gradually reduces the PGA gain by no more than 1 dB per step.

16. The noise reduction circuit of claim 1, wherein the base band DSP gradually increases a corner frequency of a high-pass filter.

17. The noise reduction circuit of claim 1, wherein the base band DSP gradually decreases a corner frequency of a high-pass filter.

18. A method for reducing noise in electronic circuits, the method comprising:

filtering an input signal using two grounding resistors and two off-chip coupling capacitors coupled to an audio signal source;

amplifying the filtered input signal in response to a control signal using a cascade of a transconductance amplifier and a transimpedance amplifier to produce an amplified signal;

coupling an output of the transconductance amplifier to an input of the transimpedance amplifier using a synchronized switch pair to couple or uncouple the output of the transconductance amplifier to the input of the transimpedance amplifier based on the control signal;

digitizing the amplified signal to produce a digitized signal; and processing the digitized signal such that the control signal is generated as an input to the amplifying step, based on a noise level of the amplified signal.

19. The method of claim 18, wherein the steps of amplifying, digitizing, and processing are integrated onto a single substrate together with the two grounding resistors that form part of the filtering step.

20. The method of claim 18, wherein the two off-chip coupling capacitors are configured in parallel.

21. The method of claim 18, wherein the filtering is adaptive to environmental condition.

22. The method of claim 18, wherein programming a corner frequency of a high-pass filter comprising the two grounding resistors and two off-chip coupling capacitors does not alter input referred noise profile.

23. The method of claim 18, wherein the step of amplifying is adjustable in increments of 1 dB steps.

24. The method of claim 18, wherein the step of processing further comprises equalizing the amplified signal such that a compression effect is substantially diminished.

25. The method of claim 24, wherein the equalizing is adaptive to the filtering.

* * * * *